United States Patent [19]

Gaffney

[11] 4,294,505

[45] Oct. 13, 1981

[54] TERMINAL CONNECTOR FOR AN ELECTRIC STORAGE BATTERY

[75] Inventor: Edward N. Gaffney, Sutton Coldfield, England

[73] Assignee: Lucas Industries Limited, Birmingham, England

[21] Appl. No.: 35,766

[22] Filed: May 3, 1979

[30] Foreign Application Priority Data

May 12, 1978 [GB] United Kingdom ..... 19141/78

[51] Int. Cl.[3] ..... H01R 11/26

[52] U.S. Cl. ..... 339/231; 339/225; 339/237; 339/238

[58] Field of Search ..... 339/95 B, 263 B, 224–240

[56] References Cited

U.S. PATENT DOCUMENTS

| | | | |
|---|---|---|---|
| 1,996,355 | 4/1935 | Smith et al. | 339/235 |
| 2,290,900 | 7/1942 | Thomas | 339/237 X |
| 2,315,399 | 3/1943 | Cline | 339/235 |
| 2,340,011 | 1/1944 | Moore et al. | 339/230 R |
| 2,531,291 | 11/1950 | Olson | 339/225 |
| 2,657,370 | 10/1953 | Hobson | 339/225 X |
| 3,764,961 | 10/1973 | Poitras | 339/238 |

FOREIGN PATENT DOCUMENTS

| | | | |
|---|---|---|---|
| 76420 | 9/1953 | Denmark | 339/237 |
| 1066018 | 1/1954 | France | 339/237 |
| 1126940 | 8/1956 | France | 339/237 |
| 2225851 | 11/1974 | France | 339/95 B |

*Primary Examiner*—Eugene F. Desmond
*Attorney, Agent, or Firm*—Ladas & Parry

[57] ABSTRACT

A terminal connector for an electric storage battery comprises an electrically insulating body having a bore therein arranged to receive a battery terminal post. Mounted in the body for movement relative thereto is an operating member which carries a conductive element to which an electrical cable is secured. The operating member is movable relative to the body, while the body remains stationary, to move the conductive element and/or the electrical cable relative to the bore in the body and into and out of electrical contact with a battery terminal post received in said bore in use.

7 Claims, 6 Drawing Figures

TERMINAL CONNECTOR FOR AN ELECTRIC STORAGE BATTERY

Figure 1:
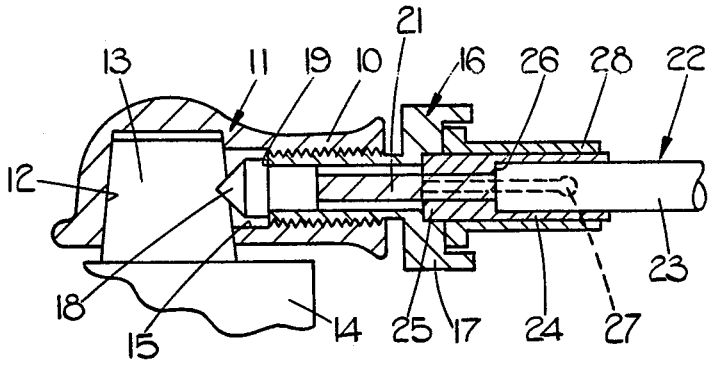

This invention relates to a terminal connector for an electric storage battery.

It is advantageous with a battery terminal connector to have the facility for rapidly breaking the electrical connection to the battery terminal so as to enable the battery to be isolated. This is particularly important when the battery is used to supply the high currents necessary to operate vehicle ignition and lighting systems and where, for example, an electrical fault could lead to a fire hazard unless the battery is isolated. With known terminal connectors, breaking the electrical connection to an associated battery terminal normally requires complete physical removal of the connector from the terminal after, for example, slackening a bolt or screw used to secure the connector to the terminal. It will, however, be appreciated this is a relatively time consuming operation and will normally require a tool such as a spanner or screwdriver.

It is known to provide a terminal connector with an isolating switch separate from the arrangement for securing the connector to a battery terminal so that, by opening the switch, it is possible to isolate the battery without physically removing the connector from the terminal. However, this construction adds significantly to the cost of the connector.

It is therefore an object of the present invention to provide a terminal connector for an electric storage battery in which the above-mentioned problems experienced in the prior art are alleviated or overcome.

Accordingly, the invention resides in a terminal connector for an electric storage battery comprising a body having a bore therein arranged to received a terminal post, a conductive element to which, in use an electrical cable is secured, and an operating member movable relative to the body and carrying said conductive element, the operating member being movable relative to the body, while the body remains stationary, to move the conductive element and/or the electrical cable relative to said bore and into and out of electrical contact with a terminal post received in said bore in use.

It will be seen that when the terminal connector described in the preceding paragraph is mounted on a terminal post of an electric storage battery the conductive element and/or the electrical cable not only allows the required electrical connection to be made to the terminal post but also constitutes the movable contact of an electrical switch, while the terminal post constitutes the fixed contact of the switch. Thus the terminal connector of the invention defines a simple and inexpensive arrangement for allowing electrical isolation of an associated electric storage battery without the need for physically removing the connector from the terminal post on which it is mounted.

Preferably, the body is formed with a passage which opens into said bore and which receives said operating member, the operating member being movable, in use, in opposite directions relative to the passage to move the conductive element and/or the electrical cable into and out of electrical contact with said terminal post.

Preferably, said passage extends transverse to the axis of the bore in said body. In this way, when the connector is located on a terminal post of an electric storage battery, the arrangement for controlling operation of the battery isolating switch projects from the side of the battery terminal and hence does not add to the overall height of the battery.

Conveniently, the conductive element is movable linearly by said operating member.

Alternatively, said conductive element undergoes pivotal movement in response to movement of the operating member.

Preferably, the connector also includes a sleeve which is carried by the operating member and through which, in use, the electrical cable secured to the conductive element is passed, the sleeve having a deformable portion and a ferrule being carried by the sleeve and being engageable with said portion so as to deform said portion and, in use, cause said portion to grip the cable.

Alternatively, the electrical cable is secured to the conductive element so as to be presented to said bore and is movable, in use, by the operating member into and out of electrical contact with said terminal post.

Conveniently, the operating member is formed of an electrically insulating material.

Figure 2:
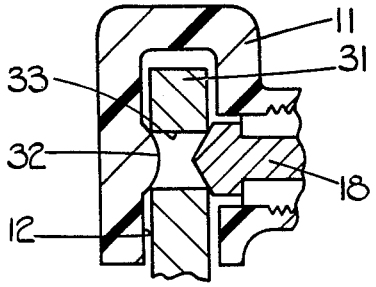
Figure 3:
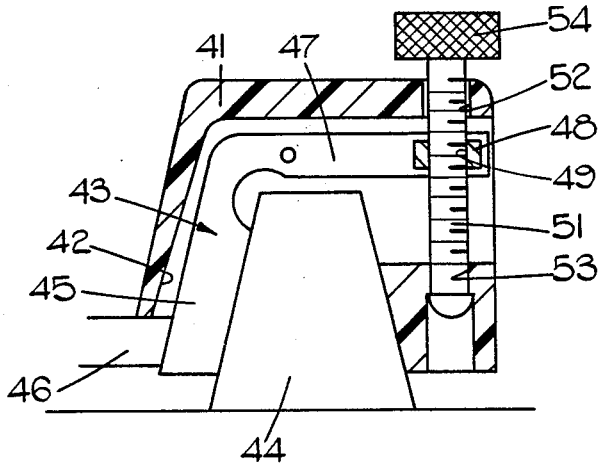
Figure 4:
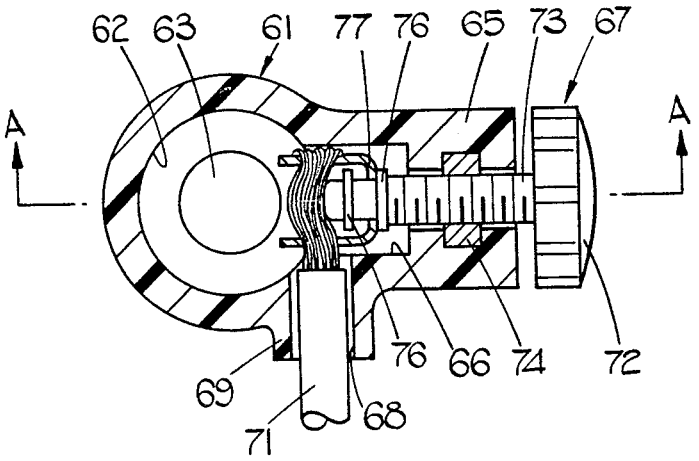
Figure 5:
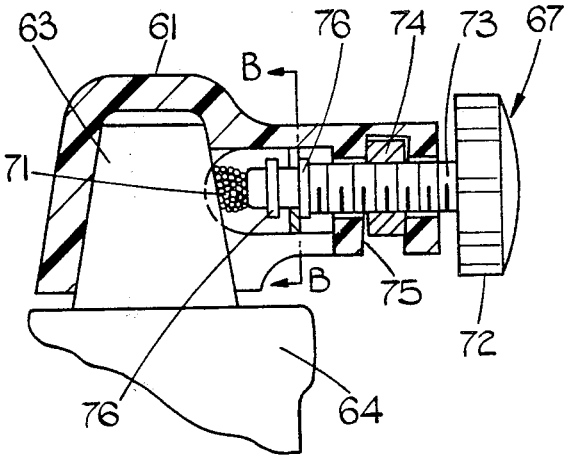
Figure 6:
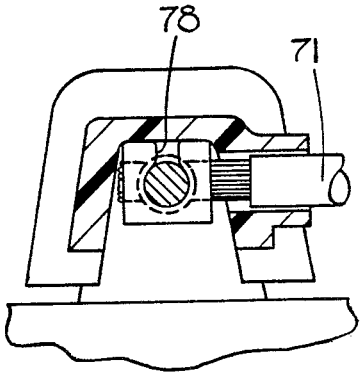

In the accompanying drawings:

FIG. 1 is a sectional view of a terminal connector according to one example of the invention;

FIG. 2 is a sectional view similar to FIG. 1 illustrating part of a terminal connector according to a modification of the first example, FIG. 3 is a sectional view of a terminal connector according to a second example of the invention, FIG. 4 is a sectional view of a terminal connector according to a third example of the invention, FIG. 5 is a sectional view along the line A—A in FIG. 4, and FIG. 6 is a sectional view along the line B—B in FIG. 5.

Referring to FIG. 1, the connector includes a body 11 composed of an electrically insulating synthetic resin material, such as nylon or another polyamide. Formed in the body 11 is a blind bore 12 adapted to receive a frusto-conical terminal post 13 of an electric storage battery 14. The bore 12 is therefore also of frusto-conical configuration but is arranged so as to define an included angle less than the included angle of the tapering wall of the terminal post 13. With a conventional terminal post this inequality is satisfied by arranging that the included angle of the bore 12 is less than 7°. By virtue of this arrangement, the body 11 undergoes a small degree of flexure when being engaged with the terminal post 13 which is found to aid retention of the connector on the terminal post.

Communicating with the bore 12 is a passage 15 which is formed in a collar portion 10 of the body so that the passage 15 extends transverse to the axis of the bore 12. The wall of the passage 15 is screw-threaded and mates with a complementary screw thread formed on the external surface of a tubular operating member 16. Thus, by rotating the operating member relative to the body 11, the operating member is movable along the passage 15 towards and away from the bore 12.

The operating member 16 is also formed of an electrically insulating material, such as a synthetic resin, and at one end projects from the passage 15 to define a flange 17 which is conveniently knurled to facilitate manual rotation of the operating member. At its opposite end, the operating member 16 carries a conductive, copper element 18 which is formed with a peripheral shoulder 19 seated against the end wall of the operating member to retain the conductive element against movement towards said one end of the operating member.

Soldered to the conductive element 18 is one end of the conductive core 21 of an electrical cable 22 having its insulating sheath 23 partly removed so as to expose said one end of the core 21. The exposed end portion of the core 21 extends through the bore in the operating member 16 and through a narrow portion of a stepped bore in an insulating sleeve 24 mounted on the cable 22. At one end defining said narrow bore portion, the sleeve 24 seats against an internal shoulder 25 defined by the operating member 16, while intermediate its ends the bore in the sleeve is stepped outwardly to define a further shoulder 26 which seats against the end of the insulating sheath 23. Formed in said one end of the sleeve 24 is a plurality of slots 27 which extend along the majority of the length of the sleeve so that the slotted region of the sleeve is deformable. Mounted on the sleeve 24 is a ferrule 28 which has an internal diameter such that it deforms the sleeve inwardly to cause the sleeve to grip the cable 22 and the exposed end of the core 21.

By virtue of the shoulders 19, 25 and 26 and the gripping action afforded by the sleeve 24, the conductive element 18, the lead 22 and the sleeve 24 are held against movement relative to the operating member 16. Thus, by imparting rotational movement to the operating member 16, the conductive element 18 is movable with the operating member along the passage 15 towards and away from the bore 12. In use, therefore, by rotating the operating member 16 in one direction the conductive element 18 can be moved into the bore 12 so as to engage and grip the terminal member 13. In this way, the conductive element 18 not only provides the required electrical connection to the terminal member 13, but also serves to retain the connector in position relative to the terminal post. If it subsequently becomes necessary to electrically isolate the battery, it is merely necessary to rotate the operating member 16 in the opposite direction whereby the conductive element is moved away from the bore 12 and hence out of electrical connection with the terminal post 13. The connector can, however, remain in position on the terminal post until the switch is re-operated to again make the electrical connection to the terminal post 13.

In the above example, the conductive element 18 includes a conical end portion which, in use, when the switch is closed, grips and makes electrical connection to the terminal post 13. It will, however, be appreciated that other shapes can be employed for the free end of the conductive element such as, for example, a curved end portion complementary with the frusto-conical configuration of the terminal post and formed with ribs to grip the terminal post. Also, to improve the electrical contact, the cable may be brought directly through the end of conductive element 18 presented to the terminal post 13 such that the element 18 causes the cable to be forced directly into contact with the terminal post when the operating member 16 is tightened.

In addition, although the operating member 16 in the above example is formed of an electrically insulating material, a conductive operating member can also be employed, in which case the conductive element can be formed integrally with the operating member. Moreover, the open end of the bore 13 may be provided with an inwardly extending annular rib to provide means for positively locating the body 11 relative to the terminal post 13 when the conductive element 18 is moved out of contact with the terminal post.

In the modification shown in FIG. 2, the connector has a similar construction to that of the above example, but is adapted to be mounted on a terminal post 31 having the shape of a rectangular section, apertured plate. The bore 12 in the body 11 is therefore shaped to receive the post 31 and the wall of the bore 12 is formed with a projection 32 which, in use, is located in one end of the aperture 33 in the post 31 to retain the body 11 relative to the post 31 when the conductive element 18 is moved out of contact with the post. When the element 18 is moved into contact with the post 31, the arrangement is such that the element 18 is located in the opposite end of the aperture 33.

Referring to FIG. 3, the connector of the second example includes a frusto-conical, insulating body 41 formed with a bore 42 in which a generally L-shaped conductive element 43 is pivotally mounted. The bore 42 is adapted to receive a frusto-conical terminal post 44 and is arranged so that, when the connector is in position on the post 44, the conductive element 43 is capable of limited pivotal movement relative to the post 44 sufficient to move one limb 45 of the element 43 into and out of contact with the post 44. An electrical lead 46 is connected to the limb 45.

Loosely carried by the other limb 47 of the conductive element 43 is a pin 48 which is formed with a screw-threaded opening 49 which mates with a screw-threaded bolt 51. The bolt 51 also extends through first and second spaced, unthreaded passages 52, 53 respectively which are formed in the body 41 and which extend parallel to the axis of the body so as to communicate with the bore 42 on opposite sides respectively of the limb 47. At one end, the bolt 51 projects from the passage 52 to define a head portion 54, which is conveniently knurled to facilitate rotation of the bolt, while at its opposite end the bolt is keyed to the body 41 so as to be free to rotate relative to the body but held against axial movement relative to the body. Thus, by rotating the bolt 51 the pin 48 can be moved in opposite directions along the bolt 51 to pivot the limb 45 of the conductive element 43 into or out of electrical contact with the terminal post.

Referring to FIGS. 4 to 6, the connector of the third example again includes an insulating, synthetic resin body 61 formed with a blind bore 62 adapted to receive a frusto-conical terminal post 63 of an electric storage battery 64. As in the first example, the body 61 includes an integral collar portion 65 which extends perpendicular to the axis of the bore 62 and is formed with a passage 66 receiving an operating member 67. Communicating with and extending transversely to the passage 66 and the bore 62 is a further bore 68 which is defined in a hollow spigot 69 integral with the body 61 and which receives the bared end portion of an electrical cable 71.

The operating member 67 is formed of an electrically insulating synthetic resin material and at one end projects from the passage 66 to define a knurled head portion 72. Adjacent said one end, the operating member includes a screw-threaded portion 73 which mates with a threaded nut 74 held captive in a recess 75 in the collar portion 65. Thus by rotating the operating member 67 relative to the body 61, the operating member is movable along the passage 66 towards and away from the bore 62. The recess 75 is dimensioned such that the threaded nut 74 is loosely contained therein and the walls of the recess, which are spaced apart along the axis of the collar portion 65, are inclined at a shallow angle (of the order 2°), to the adjacent end surfaces of the nut 74. The effect of this will be explained later.

At its other end, the operating member 67 is slidably mounted in a slot 78 formed in the base of a generally U-shaped conductive element 77, so that said base is loosely received between a pair of spaced annular ribs 76 integral with the operating member. The walls of the slot 78 are shaped to prevent disengagement of the conductive element from the operating member but are flexible to permit assembly of the conductive element between the ribs 16 of the operating member. The limbs of the conductive element 77 project from the operating member 67 towards the bore 62 so that when the body 61 is mounted on the terminal post 63, the post partly lies between the free ends of the limbs. The bared portion of the cable 71 extends through respective apertures in the limbs of the element 77 over said other end of the operating member 67 with the free end of the cable being bent over to prevent disengagement from the element 77. Thus, by rotating the operating member 67, the bared portion of the cable 71 can be urged by the operating member against the terminal post 63 to complete the required electrical connection to the post. Moreover, by virtue of the aforementioned shaping of the recess 75, as the operating member urges the bared portion of the cable 71 against the terminal post, so the nut 74 will be forced against the inner inclined wall of the recess 75 which will exercise a locking action between the nut 74 and the screw-threaded portion 73 of the operating member 67 to prevent the parts becoming loosened by vibration.

If it is subsequently necessary to electrically isolate the battery, the operating member is rotated in the opposite direction whereby the operating member is initially moved relative to the conductive element 77 until the trailing rib 76 engages the base of the element 77. Thereafter, during further rotational movement in said opposite direction the operating member 67 draws the element 77 and hence the cable 71 away from the terminal post 63 to disconnect the cable from the terminal post.

It will be appreciated that the operating member 67 of FIGS. 4, 5 and 6 could be mounted in a similar manner to the operating member 54 of FIG. 3, the limb 45 of which would carry the conductive element 77.

Using the device shown in FIGS. 4, 5 and 6, it has been found that the heavy gauge cable used in vehicular wiring performs satisfactorily without being distorted away from the abutting end of the operating member 67. However, if required this end could be shaped to aid the containment of the wire for example by preventing a semi-cylindrical concave profile whose axis is at right angles to that of the operating member. It will be appreciated that such an arrangement would necessitate the profile being non-integral with the operating member, but being joined to, and free to rotate about the operating member.

It will also be appreciated that, while in the examples quoted, the body is electrically insulating, it could be made from electrically conductive material. However, with an electrically conducting body, the operating member 16 in the example shown in FIGS. 1 and 2, would have to be electrically insulating, as would the operating member 67 of FIGS. 4, 5 and 6. In the case of the example shown in FIG. 3, the pin 49 and/or the bolt 51 would have to be electrically insulating, if the body were electrically conducting. However, the preferred materials are as quoted in the examples.

Finally, it will be appreciated that in each of the above examples the body of the connector remains fixed, in use, relative to the terminal post of an associated battery, while the conductive element and/or the electrical cable are moved by the operating member into or out of electrical contact with the terminal post.

What is claimed is:

1. A terminal connector for an electric storage battery comprising a body having a bore therein arranged to receive a terminal post, an electric cable, a conductive element to which the electric cable is secured with the cable being presented to said bore, and an operating member movable relative to the body and said conductive element and carrying said conductive element, the operating member being movable relative to the body, while the body remains stationary, to move the conductive element and the electrical cable relative to said bore whereby the electrical cable can be moved into and out of electrical contact with a terminal post received in said bore in use.

2. A terminal connector as claimed in claim 1, wherein the body is formed with a passage which opens into said bore and which receives said operating member, the operating member being movable, in use, in opposite directions relative to the passage to move the conductive element and the electrical cable into and out of electrical contact with said terminal post.

3. A terminal connector as claimed in claim 2, wherein said passage extends transverse to the axis of the bore in said body.

4. A terminal connector as claimed in claim 1, wherein the conductive element is movable linearly by said operating member.

5. A terminal connector as claimed in claim 1, wherein said conductive element undergoes pivotal movement in response to movement of the operatingl member.

6. A terminal connector as claimed in claim 1, wherein said body is formed of an electrically insulating material.

7. A terminal connector as claimed in claim 1, wherein the operating member is formed of an electrically insulating material.

* * * * *